US005145490A

United States Patent [19]

Sadowski

[11] Patent Number: 5,145,490

[45] Date of Patent: Sep. 8, 1992

[54] PROCESS FOR FIXED BED COAL GASIFICATION

[75] Inventor: Richard S. Sadowski, Greenville, S.C.

[73] Assignee: CRS Sirrine Engineers, Inc., Houston, Tex.

[21] Appl. No.: 814,102

[22] Filed: Dec. 26, 1991

Related U.S. Application Data

[62] Division of Ser. No. 565,039, Aug. 9, 1990.

[51] Int. Cl.[5] ..... C10J 3/14

[52] U.S. Cl. ..... 48/197 R; 48/203; 48/206; 48/209; 48/210

[58] Field of Search ..... 48/63, 64, 76, 77, 68, 48/66, DIG. 4, 203, 206, 67, 69, 62 R, 87, 197 R, 209, 210

[56] References Cited

U.S. PATENT DOCUMENTS

| | | | |
|---|---|---|---|
| 2,577,632 | 12/1951 | Roetheli . | |
| 2,582,710 | 1/1952 | Martin . | |
| 2,582,712 | 1/1952 | Howard . | |
| 2,662,816 | 12/1953 | Kalbach | 48/202 |
| 2,677,603 | 5/1954 | Vanloon . | |
| 3,463,623 | 8/1969 | Forney et al. . | |
| 3,540,867 | 11/1970 | Baron et al. | 48/197 |
| 3,951,616 | 4/1976 | Rudolph | 48/85.2 |
| 4,165,970 | 8/1969 | Rudolph et al. . | |
| 4,200,438 | 4/1980 | Kaimann et al. | 48/206 |
| 4,300,914 | 11/1981 | Rice . | |
| 4,372,756 | 2/1983 | Whitten et al. | 48/202 |
| 4,400,181 | 8/1983 | Snell et al. . | |
| 4,405,339 | 9/1983 | Kunii | 48/62 R |
| 4,405,340 | 9/1983 | Kupfer et al. | 48/86 R |
| 4,441,992 | 4/1984 | Schuster | 48/197 R |
| 4,799,937 | 1/1989 | Nieminen | 48/62 R |
| 4,987,115 | 1/1991 | Kim | 48/197 R |

OTHER PUBLICATIONS

M. Gomez et al., "Entrained-Bed Carbonization of Highly Fluid Bituminous Coals", *U.S. Dept. of the Interior*, Bureau of Mines, RI 7141 (1968).

Draft Document, "Gasifier Design Modifications Required to Accommodate High Free Swelling Coals", *Contract No.* DE-AC21-89MC26291, *U.S. Dept. of Energy*, (Jun. 1990).

*Primary Examiner*—Peter Kratz

*Attorney, Agent, or Firm*—Pravel, Gambrell, Hewitt, Kimball & Krieger

[57] ABSTRACT

The combustion of gas produced from the combination of coal pyrolysis and gasification involves combining a combustible gas coal and an oxidant in a pyrolysis chamber and heating the components to a temperature of at least 1600° F. The products of coal pyrolysis are dispersed from the pyrolyzer directly into the high temperature gasification region of a pressure vessel. Steam and air needed for gasification are introduced in the pressure vessel and the materials exiting the pyrolyzer flow down through the pressure vessel by gravity with sufficient residence time to allow any carbon to form carbon monoxide. Gas produced from these reactions are then released from the pressure vessel and ash is disposed of.

2 Claims, 3 Drawing Sheets

PROCESS FOR FIXED BED COAL GASIFICATION

This is a division of U.S. application Ser. No. 07/565,039 filed Aug. 9, 1990.

BACKGROUND OF THE INVENTION

Conversion of coal, char, or coke to a gaseous product by reaction with heated air, oxygen, steam, or carbon dioxide or mixtures of these comprise the well-known process called coal gasification. The product of coal gasification is a mixture containing hydrogen and carbon monoxide and varying amounts of nitrogen, carbon dioxide, steam, hydrogen sulfide, organic sulfur compounds, and possibly tar and dust, depending on the gasification process and reactants employed.

Processes have been investigated for coal gasification at atmospheric and elevated pressures for nearly a century, but many problems still remain that inhibit efficient gas production. There is a tendency for coal to form a sticky agglomerating surface; the result of the tar and asphalt fractions of coal forming exudates when the coal is heated, and gasifiers that utilize coals with high free swelling indexes have been plagued with problems of coal clumping and caking.

Since the typical gasifier is a counterflow device, whereby the coal flows downward under the force of gravity, while air and steam used to heat and gasify the coal move upward through the coal bed, raw coal is fed to a relatively cool zone in the upper portion of the gasifier near where coal gases and other volatiles leave the device. This aggravates the swelling and caking characteristics of coal.

The conventional Lurgi pressure gasifier comprises a pressure vessel having at its upper end a coal lock hopper through which sized coal is introduced under pressure. The coal bed is stirred at its upper end to maintain porosity of the devolatilization zone and to break up any forming agglomerates. The coal is heated to between 1800° F. and 2300° F. by adding heated steam and oxygen at the lower end of the pressure vessel. A rotating grate is disposed within the lower end of the pressure vessel and is charged with coal to be gasified. The Lurgi gasifier has a major disadvantage in that the raw gas outlet is very near the top of the coal bed so that tars and fine grained dust and coal can be entrained within the exhaust stream of the gasifier.

The Morgantown Energy Technology Center (METC) gasifier is based on a similar concept, in which the coal is introduced at the top and air/steam are introduced at the bottom in a countercurrent manner. Typically, a pressurized lock hopper supplies coal to a variable speed rotary feeder which dispenses coal to a screw feeder. The screw feeder runs at a constant speed which is fast enough so that it always moves the coal into the volume of the pressure vessel before it can be hot enough to become sticky and initiate blockage. A water cooled, hydraulically driven, three blade stirrer is used to maintain bed porosity and provide a capability to utilize strongly caking coals. As with the Lurgi gasifier, tars and fines exist in the product gas. More importantly, the METC design requires a deep bed stirring function. This imposes complex forces on the bearing and pressure seal design for the water cool shaft which both slowly rotates and translates as it penetrates the gasifier pressure vessel.

Use of highly caking coals in these conventional coal gasifiers results in decreased throughput and therefore gasification output is drastically reduced at times to less than half the full load capacity. This is the direct result of the sticky, swelling coal which forces the gas path to short circuit through cracks within the coal bed. This short-circuiting is called "channeling" and is a significant problem because it ruins the necessary gas to coal contact and interaction that are needed to carry out efficient gasification reactions.

If the heating of coal could be performed at temperatures high enough to hasten the transient time through the gasification device, the swelling process itself could be limited even for highly caking coals. Therefore, it would be useful to provide a coal gasification process which allows the coal to become devolatilized by heating without agglomeration and subsequent channeling.

SUMMARY OF THE INVENTION

It is therefore an object of this invention to provide a process and apparatus for fuel gasification with in enhanced ability to process wider ranges of coal without capacity limitations.

It is a further object of this invention to provide a coal gasification process and device that does not rely on countercurrent flow, thereby minimizing coal tar carry over into the combustible gas that is produced.

It is a further object of this invention to minimize the carry over of volatilized alkalis of sodium and potassium into the combustible gas produced.

It is a further object of this invention to provide a coal gasification device and process that minimizes air and steam channeling through the coal bed.

This invention provides for process and apparatus for fixed bed fuel gasification useful for gasifying even highly caking substances such as coals.

The apparatus of this invention utilizes a coal pyrolysis device within the confines of a pressure vessel. The pyrolysis device comprises an open-ended tubular housing. This housing projects into the pressure vessel. Preferably, the housing is coaxially aligned with a fixed-bed coal gasifier pressure vessel. An annular space is defined between the pyrolysis device and the pressure vessel and a rotating grate housed within the space is disposed around the pyrolysis device. Material related from the tubular pyrolyzer into the pressure vessel can be deposited on the grate. The lower end to a temperature sufficient to volatilize the coal components and form a protective crust on the coal surface rather than forming a sticky tar exudate. The products of coal pyrolysis exit from the upper end of the pyrolysis device directly into the coal gasification pressure vessel. Gasifying reactants are supplied to the pressure vessel adjacent to the exit end of the pyrolyzer. Sufficient residence time is provided for the materials in the pressure vessel to react with the gasifying reactants in order to allow the carbon content of the devolatilized coal to be oxidized to carbon monoxide. Gasification is accomplished in this pressure vessel without concern for coal caking and attendant agglomeration.

The process of the invention comprises the steps of introducing fuel into a first end of an open-ended pyrolyzer tube. The fuel is entrained within the tube and heated by combining a combustible gas and an oxidant with the fuel. These components stream in a common direction and the fuel is devolatilized. The products of pyrolysis are then partially combusted in a fixed-bed gasifier pressure vessel. Devolatilized fuel is dispensed from the pyrolyzer directly into the pressure vessel as a combination of gas, and ash which falls by gravity within the gasifier pressure vessel. Steam and air needed for carbon gasification are introduced at the top of the pressure vessel such that gas and ash exiting the pyrolyzer flow co-currently down through a hot gasification region of the pressure vessel with sufficient residence time to allow any carbon to form carbon monoxide. The low BTU gas produced from the combination of fuel pyrolysis and gasification is then released from the pressure vessel.

DETAILED DESCRIPTION OF THE INVENTION

In broad aspect, the apparatus comprises at least two components, a pressure vessel for gasifying fuel and a means for pyrolyzing solid fuel. Both components can be linked in a variety of ways. It is important, however, that substantially all of the fuel be pyrolyzed prior to gasification. This ensures that the fuel particles will not clump or agglomerate, as described below. Preferably, the devolatilized and pyrolyzed fuel exits the pyrolyzer into the high temperature region of the gasifier. The solid material that undergoes gasification falls by gravity to a fixed-bed rotating grate. In one preferred embodiment, the pyrolyzing component enters the pressure vessel from below, although other configurations are possible. The term "fuel" is meant to include any solid, carbonaceous material. Examples include, but are not limited to, coal, refuse-derived materials, and wood. Although the description of the apparatus and methods of this invention refer to coal, it is understood that the other fuels mentioned above can be used as well.

Figure 1:
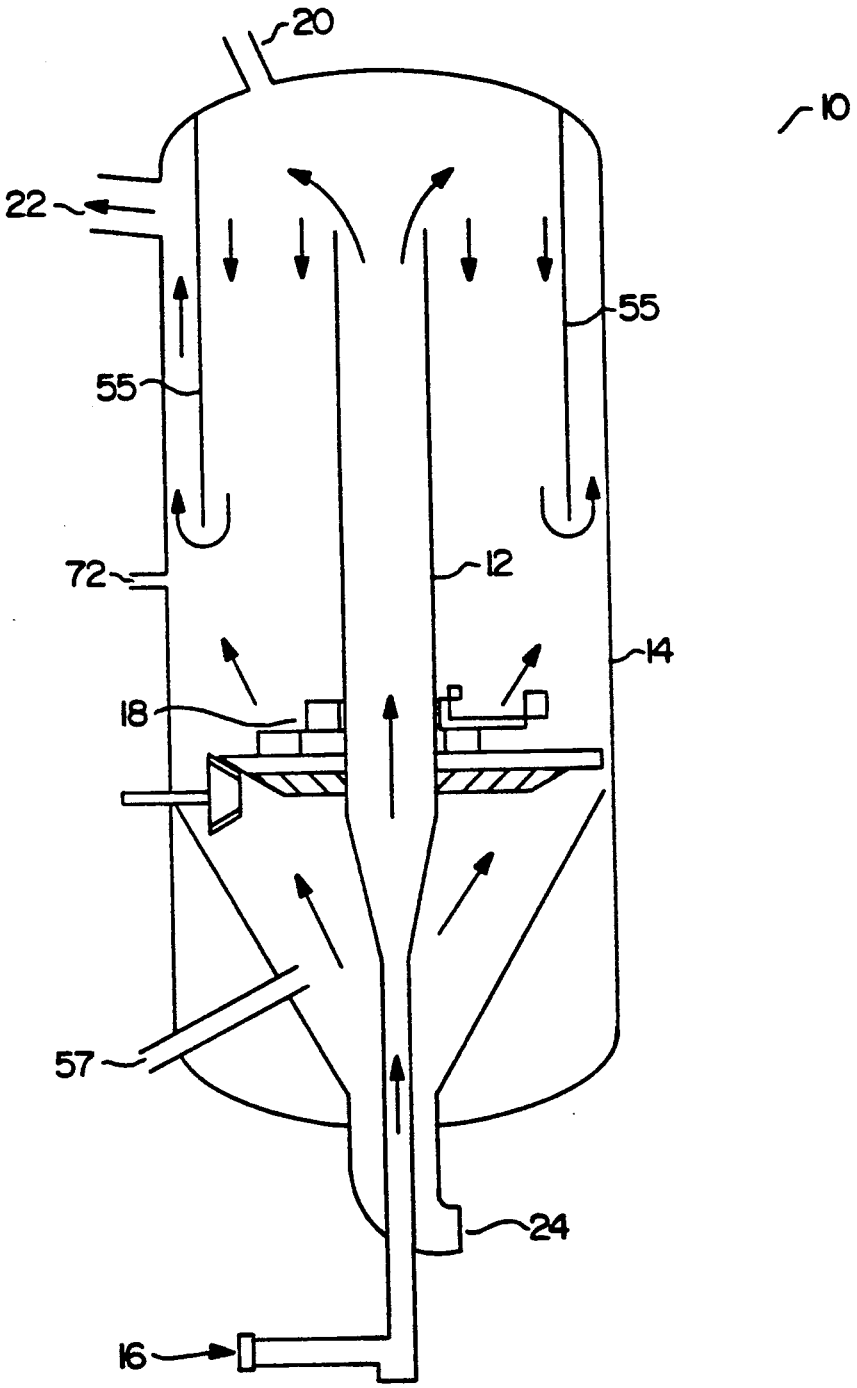
FIG. 1 is a schematic illustration of the gasification device of this invention.

A schematic illustration of an embodiment of the coal gasification device of this invention is shown in FIG. 1. The apparatus 10 comprises two components, an entrained-bed pyrolysis device or pyrolyzer 12 coaxially aligned with, and substantially housed within, a pressure vessel 14. The pyrolyzer 12 combines coal, air and a combustible gas 16 and concurrently passes the ignited mixture thereof upwards at high temperature through the pyrolyzer 12. Sticky tar released from the coal as it begins to volatilize, cracks at the high temperatures produced in the pyrolyzer. The cracking of the tar and the asphalt fractions of coal reduces the tendency of the coal to form a sticky agglomerating surface within the gasification device. The products a coal pyrolysis exit from the top of the pyrolysis device 12 and the solid materials fall by gravity onto the fixed bed upper surface 18 of the pressure vessel 14. The solid materials released from the pyrolysis device are oxidized in the presence of heated air and steam which are introduced through conduit 20 at the top of the pressure vessel. The carbonaceous, and other gases, produced then pass downward concurrently, then upward around internal flange 55 and then exit the pressure vessel through conduit 22. Noncombustible solid material such as ash exits the device through an exit port 24. Sufficient air to burn out residual carbon left in the ash plus steam (as needed) to cool the grate are introduced through conduit 57.

The term "pyrolysis" is meant to define a general process of heating coal which involves extensive thermal decomposition of the coal and the progressive enrichment of the residual solid material in carbon. Typically, this occurs at temperatures greater than 500°-550° C. (932° F-1022° F.). The products of typical high temperature pyrolysis of coal are: (a) a hydrogen rich volatile fraction comprising gases and tar, and (b) a carbon rich solid fraction called char. The gaseous volatiles produced by coal pyrolysis include but are not limited to methane, carbon monoxide, carbon dioxide, water vapor, hydrogen, ethane, and oxides of nitrogen. The term "entrained-bed" defines a method of pyrolysis using a stable suspension of coal particles in a rising gas steam. These coal particles are carried by a primary gas flow through an injector and into a hot, vertical furnace.

Figure 2:
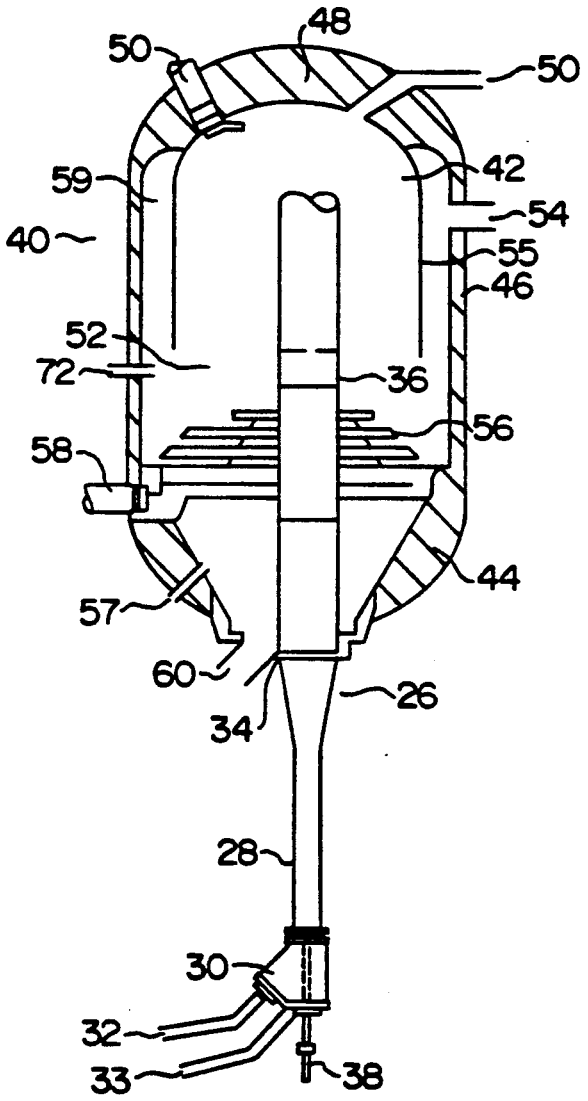
FIG. 2 illustrates the major operating features of the gasification device of this invention.

Referring to FIG. 2, the entrained bed pyrolyzer 26 is of conventional design. The pyrolyzer is an open-ended tube or cylinder 28, which cylinder can be heated to at least 1037° C. (1900° F.). The pyrolyzer overcomes the central difficulty encountered with pyrolyzing coal i.e., caking of the coal as it is being heated, by surrounding the heated coal particles with an inert material in an entrained-bed. Preferred inert materials comprise char, limestone, or sand. The inert material serves three major purposes. The violent agitation of sand or char provides extremely rapid heat transfer to the carbonaceous fuel particles which undergo abrasion and grinding. This abrasion constantly exposes fresh reactive solid surfaces as well as reducing the tendency for the reacting fuel particles to agglomerate. Thus the coal particles are diluted enough by the inert char or sand to avoid caking. Secondly, the inert material bed acts as a massive heat sink to dampen temperature fluctuations. Thirdly, the limestone calcines and removes some sulfur in the form of calcium sulfide (CaS).

The pyrolyzer operates with crushed coal on the order of 1/10 inch. The preferred means particle sizes of coal used in the pyrolyzer are between about 0.015-0.250 inches. Crushed coal of this size has enough surface area to become devolatilized quickly when heated to about 870° C. (1600° F.).

Referring again to FIG. 2, there are three sections in the entrained-bed pyrolyzer of this invention. In the hot bottom chamber 30, a combustible startup gas, such as natural gas (more than 90% methane), is burned in the presence of an oxidant. The oxidant, such as air is introduced via a gas inlet 32. The hot combustion gases are mixed for passing through the other sections of the pyrolyzer, the grid plate 34, and the reactor bed 36. A smaller tubing 38 of type 347 alloy is coaxially aligned with the lower end of the pyrolyzer. This smaller tube transports the coal that is pneumatically fed into the pyrolyzer 26. The pneumatic coal feed rate at the lower end of the pyrolyzer can vary, but is generally between about 250-1500 lbs./hr-ft$^2$. Mixing of the hot combustion gases causes a stable suspension of coal particles to be formed in the rising gas flow. The composition of the combustion gas can be adjusted within a limited range with additional air from an air inlet conduit 33 to form specific component ratios.

Between the gas combustion chamber section 30 and the reactor bed section 36 is the optional grid plate 34. This plate is a gas distribution plate and can be made of type 310 stainless steel, although other compositions can be used just as effectively. The gas distribution plate contains a plurality of holes extending entirely through the plate. These all sever to mix the combustion gases and distribute the hot gases evenly into the reactor bed section 36.

Approximately upper two thirds section of the pyrolyzer comprises the reactor bed section 36, which section is enclosed within the pressure vessel 40. The reactor section comprises the entrained bed comprising inert particles, preferably char, and combustion coal particles. The reactor section containing the entrained bed is comprised of flame-resistant alloy. The insulation lining can be fire brick and castible refractory, although other heat-resistant compositions and/or welded water cooled tubing can be used as well. Above the reactor bed section 36, the reactor diameter is generally constant but can be expanded to provide a larger chamber. The upper section of the pyrolyzer is lined in the same manner as the reactor bed section.

The bed height of the pyrolyzer, i.e., the vertical length of tubing within which the coal and inert material is contained, can vary but is generally between 9 ¾and 31 feet in length. Thus, the relative dimensions of the pyrolyzer components can vary within a wide range, depending on the circumstances. For example, the lower end of the pyrolyzer can be as small as about 4 inches outside diameter, having a tubing 38 about 1 inch outside diameter. With these dimensions, the reactor section containing the entrained bed can be 8 inches in outside diameter. These dimensions can be scaled up accordingly using engineering and construction methods well known in the art.

The pyrolyzer produces enough heat to drive off the volatile matter in the coal, resulting in two products, low BTU combustible gas and additional char (unreacted carbon and ash). The pyrolyzer component of the invention does not suffer from coal caking and agglomeration because coal and air passes upwards co-currently at high enough temperatures to from a protective crust o the coal surface rather than forming a sticky tar exudate. At the higher temperatures of the pyrolyzer, (about 870° C., ~~1600° F.), the tar exudate cracks into carbonaceous char.

Nevertheless, the pyrolyzer does not consume much fixed carbon in the coal. Therefore, the char produced as the result of rapid pyrolysis is not gasified sufficiently to render any ash produced during the gasification process capable of disposal.

In order to further partially oxidize the coal without agglomeration, the pyrolyzer 26 exits directly within the confines of a pressure vessel 40. Volatilized effluent gas which contain bituminous tar and the solid products of pyrolysis (coal, ash, and char) are forced from the upper exit end of the pyrolysis tube and pass through a high temperature section of the pressure vessel 42 where the tars are further cracked into carbon and gaseous hydrocarbons.

The pressure vessel 40 or fixed-bed coal gasifier, oxidizes most of the fixed carbon content of the coal. Products of coal gasification are low BTU gas which contains more carbon monoxide than that produced during pyrolysis since more of the carbon is utilized in coal gasification. Ash, with a small amount of unreacted carbon are the remaining products.

Referring to FIG. 2, the gasifying reactor pressure vessel 40 comprises a reactor shell 44 of finite thickness, the thickness defining a wall 46. The gasifier wall 46 can be lined with insulating, high temperature refractory 48. Although a significantly increased tendency toward clinkering has been reported in refractory-lined, conventional gasifiers, the apparatus embodied herein can avoid this problem because the pyrolyzer tube effectively reduces the volatile components of the coal to a level where clinkering is difficult. Thus, the pressure vessel can be lined with refractory without adverse effects. Alternatively, the reactor can have a wall that is water-cooled along all, or some portion, of its length.

The gasifying reactor 40 may be designed to withstand atmospheric pressures up to 40 atmospheres (6–7 MPa). Temperatures in the pressure vessel typically range from 925°–1050° C. (1697°–1922° F.). At these temperatures and under these pressures, the hydrogenation of carbon is favored so that the product gas may typically contain 50% hydrogen, 35% carbon monoxide and 15% methane when oxygen is used as a gasifying agent. When air is used as a gasifying agent, the product gas may typically contain 15% hydrogen, 20% carbon monoxide, and 3% methane. The shell 44 is provided with a plurality of conduits 50 for introduction of gasifying agents, i.e., heated air, steam, oxygen and/or carbon-dioxide. These conduits 50 are located at or near the top end of the pressure vessel in order to react said agents with any devolatilized coal and gas that pass upwardly and exit from the pyrolyzer reactor bed 36 as an effluent comprising gas and ash-bearing char. The pressure vessel 40 is therefore specifically designed so that gasifying agents needed for carbon gasification are introduced at the top of the pressure vessel in order to allow for concurrent gas and char flow down through the high temperature section or gasification region 42 of the pressure vessel 40.

The gasification region 42 is located near the upper end of the pyrolyzer and extends some distance downwards therefrom. It comprises a region of gasification at a temperature of between 982° C. (1800° F.) and 1260° C. (2300° F.). The principal reactions in this gasification zone are:

Exothermic combustion of carbon;

$$C+O_2 \rightarrow CO_2$$

Endothermic reactions of carbon with steam and carbon dioxide; $C+H_2O \rightarrow CO+H_2$ $$C+CO_2 \rightarrow 2CO;$$

Exothermic water-gas shift reaction;

$$CO+H_2O \rightarrow CO_2+H_2$$

Methane can be produced from a hydrogenation of carbon and from the thermal cracking of carbon at the high pressures encountered in the pressure vessel.

Coal exiting from the pyrolyzer 26 and air (or oxygen) and steam (or water), entering from the conduits 50, flow concurrently down through the pressure vessel 40. Volatilized gas which exits the pyrolyzer 26 is forced to pass through the high temperature zone of the carbon gasification vessel 42 where the tars are cracked into carbon and gaseous hydrocarbons. This internal recycling of effluent gas minimizes coal tar carry over into the combustible gas produced. The co-current flow is also advantageous because volatilized alkalis of sodium and potassium formed during pyrolysis and in the high temperature zone 42 of the gasifier will condense and precipitate onto the ash when cooled below 870° C.

(1600° F.) in the cooler regions 52 of the gasification reactor.

Alkali-free gas is removed from the pressure vessel 40 through one or more exit conduits 54 located near the top end of the pressure vessel 40. Preferably, the exit conduits 54 are located exterior to an internal skirt or flange 55, which flange is disposed inside the pressure vessel 40 and is substantially parallel to the walls of the pressure vessel. This flange defines a space 59 between the walls 46 of the pressure vessel 40 and the flange 55 and serves to force gases exiting from the top of the pyrolyzer cylinder 26 downwards through the high temperature zone 42 of the gasification pressure vessel. The exit conduits 54 cooperate with the space 59 defined by the flange 55 and pressure vessel 40. The flange ensures a more efficient co-current flow that maximizes internal recycling of effluent gas, since the gases that exit the pyrolyzer are forced to follow a circuitous path before they leave the pressure vessel 40.

As the co-current flow of exiting pyrolysis gas, char and gasifying agents flow downward through the cooler regions of the gasification zone 52, they encounter temperatures lower than about 870° C. (1600° F.) where the remaining uncombusted carbon and ash are deposited on the grate 56. Additional air and steam conduits 57 are disposed at the bottom of the pressure vessel adjacent to the grate 56. These additional air and steam conduits serve a dual purpose. They provide cooling for the grate and also provide additional gasifying agents to complete the final combustion of any carbon that has been deposited upon the grate 56.

This grate 56 can be of any mechanical grate type so long as it is modified to accommodate the pyrolyzer cylinder 26. The grate 56 provides the function of being the physical support of the mass of the bed. It also removes the lowest portion of the bed solids at a controlled rate. Theoretically, the bottom of the bed is removed at the same rate that the combustion zone moves upward in the gasifier, causing the combustion zone to remain vertically fixed. The volumetric solid removal rate is determined by the rotation of the grate.

Preferably, the grate 56 is rotated by a rotating element 58 and causes the ash to fall generally downward along the surface of the grate to a withdrawal port 60. The grate design shown in FIG. 2 is a Lurgi-type grate, although other designs can be used as well.

Figure 3:
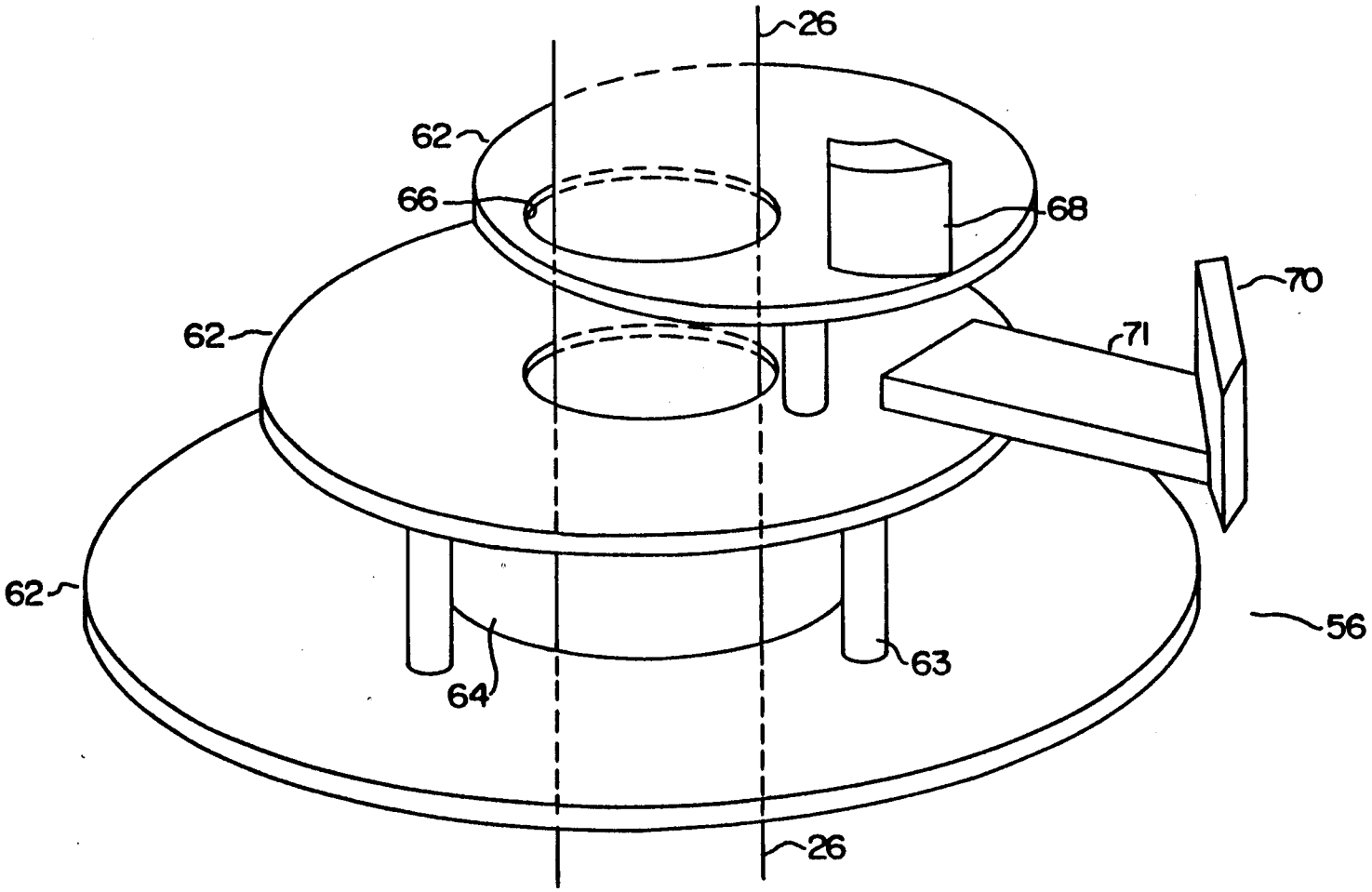
FIG. 3 illustrates a closeup of the rotting grate, as shown in FIGS. 1 and 2.

Another embodiment of a rotating grate is a modified METC-type grate having interconnected multiple parallel horizontal plates 62 is shown in FIG. 3. Each horizontal plate has a bore 64 extending completely therethrough. The plates 62 are connected by their horizontal surfaces to each other by a plurality of connecting elements 63 aligned so that their respective bores form an annular space into which the pyrolyzer tube 26 can be disposed. The pyrolyzer tube is not necessarily sealingly engaged with the bores of the plates but rather, the tube is of substantially smaller diameter than the bore so that a space of finite thickness is defined between the tube 26 and outer edge 66 of the bore 64. Several of the multiple parallel horizontal plates 62 are eccentric to the pyrolyzer center line which is the axis of grate rotation (in FIG. 3, only the uppermost plate is shown in this configuration). Some of these plates carry plows 68, 70 to control the radial flow of ash. The assembly is rotated within a strong wear collar of bearing (not shown). In preferred operation, the grate rotates clockwise as viewed from the top of the pressure vessel and at least one of the two top plates 62 is eccentric to the center line of the pyrolyzer 26. Because the pyrolyzer 26 is also coaxial with the central line of the pressure vessel, at least one of the two top plates 62 are eccentric to the gasifier center line as well. Ash is scooped from the gasifier wall region by the removal plow 70 located on the middle plate 62 and is forced radially inward to pass over/under the middle plate 62 and fall through the large central holes 64 in the middle and bottom plates into the withdrawal port 60. The removal plow 70 is mounted on an extension 71 affixed to the outer periphery of the plate, the extension 71 projecting radially outward therefrom. A deflector plow 68 caused ash resting on the top plate 62 to be deflected and fall to a lower level where it is picked up by the removal plow 70. While some ash falls past the periphery of the bottom plate into the withdrawal port 60, the vast majority of ash exits the grate 56 region through the center hole 74 in the bottom plate 62. Any agglomerates too big to pass through the gaps between the plates tumble past the plow and are crushed between the eccentrically mounted plates and surrounding bearing as the eccentrically mounted plates goes to near zero clearance.

The withdrawal port 60 can be a simple conduit through which ash exits the apparatus.

The principal virtue of this grate design is its ability to effectively control the flow of nearly any type of ash from powder to small clinkers. The size of the clinker which can be accommodated is determined by the plate to plate spacing as determined by the length of the connecting elements 63. Preferably, the spacing is six inches.

In a further embodiment of the invention, clinkers can be removed from the pressure vessel by providing intermittent water spray injection for shattering clinker formations. Referring to FIGS. 1 and 2, water is introduced into the sides of the pressure vessel 40 by water conduits 72 disposed at the lower end of the pressure vessel. The water spray devices can be retracting and can act intermittently. Typical coal gasifiers are shut down when such operations result in clinker formations larger than can be passed by their rotating grates. Use of cooling and clinker shattering with water spray feed conduits can prevent the pressure vessel from having to shut down should poor operating practices allow temperatures excursions wide enough to cause clinker formation. Clinker formation has no immediate effect on gas quality but it reduces or eliminates the gasifier's ability to discharge ash. This then allows the reaction zones to move upward in the gasifier and eventually destroys the gas heating value of the produced gas.

Further embodiments of this invention also provide for measurements critical to the operation of the fixed bed gasifier. These parameters include temperatures levels in the lower regions, product gas temperature, input flows and temperature of the reactants, physical location of the coal bed, and product gas heating value.

Observing temperature levels in the lower portions of the gasifier provides what is likely the most feasible means to locate the position, extent, and intensity of the combustion zone. This can be obtained by having water cooled temperature profile monitors inserted into the high temperature section 42 of the pressure vessel.

The product gas temperature, although not actually needed for control of the gasifier, becomes very valuable if gasifier operations become truly abnormal with the combustion too high in the bed. This temperature can be readily obtained from a simple, commercially available gas stream probe.

Measurement of the temperatures and flow rates of the steam and air feed conduits 50, to the gasifier is well within the state of the art and can be obtained using conventional flow meters.

The location of the physical surface of the coal bed is important to maintain relative constancy of the product gas characteristics. Various approaches to this measurement exist and can be utilized in the present invention. Such approaches include electrically resistance/capacitance probes and nuclear gages. The most reliable technique utilizes a nuclear gage to measure the attenuation of a beam of nuclear radiation by the coal bed. In a preferred embodiment of this invention, this densitometry is based on gamma ray production from an externally mount cobalt 60 source being sensed by an array of ionization chambers located on the side of the pressure vessel opposite to the cobalt 60 source. Cobalt-60 sources are commercially available, relatively low in cost and provide gamma rays at 1.17 and 1.33 Mev.

Having now described the apparatus for coal gasification, the process shall now be described with particular reference to FIG. 2. The pyrolyzer 26 is designed to produce gas from coal by driving off the volatile matter in the coal resulting in combustible gas and char. The pressure vessel fixed bed gasifier 40 is designed to remove most of the fixed carbon content of the remaining coal in addition to its volatile content, thereby producing BTU gas and ash.

To operate the entrained bed pyrolyzer 26, the reactor bed section 36 is filled with inert material to a predetermined bed height. The gas velocity through the bed provided by inlets 32, 33 is maintained at a level to ensure rapid agitation of the char and then the bed is heated to the preselected temperature, between about 760° C. (1400° F.) and 1037° C. (1900° F.) by combustion of the gases in the bottom section 30 of the reactor.

After the bed 36 reaches the desired temperature, the gas flow rates are adjusted to give the appropriate parameters as determined by the particular conditions. The entrained bed pyrolyzer is then allowed to come to an approximate steady state condition as judged by, for example, a constant bed temperature. Carbonaceous fuel is introduced into the pyrolyzer, by for example, pneumatic transport. Typically, the bed temperature will immediately drop because of the sensible heat required to heat the coal to the reaction temperature plus the heat of pyrolysis. The pneumatic transport of coal and the gas flow rates can be adjusted so that the entrained bed temperature does not drop below about 760° C. (1400° F.). The pyrolyzer tube is heated to devolatilize the fuel at high enough temperatures to form a protective crust on the coal surface. Temperatures within the range of 870° C. (1600° F.) to 1037° C. (1900° F.) are preferred. The devolatilized fuel and char is discharged under pressure from a top end of the pyrolyzer tube directly into the top end of the pressure vessel 40. Steam and air needed for carbon degasification are introduced via conduits 50 at the top of a pressure vessel such that both gas and char flow concurrently down through a hot gasification region 42 of the pressure vessel. Preferred temperatures of this region are between 980° C. (1800° F.) and 1260° C. (2300° F.) as permitted by coal fusion characteristics.

The unreacted fuel, and ash produced during the gasification process are allowed to cool. Unreacted fuel including remaining ash is deposited on the rotating grate 56 then removal from the pressure vessel through the withdrawal port 60.

An important characteristic of this procedure is that the hot gas stream exiting from the pyrolyzer tube 26 must pass through the hot carbon gasification zone 42 in the presence of additional steam and air in order to crack any tars and to provide sufficient ash surface for alkali deposition upon cooling prior to exiting the ash bed. This is particularly advantageous in this air blown gasification system because a hot gas stream can be maintained all the way to a gas turbine without any concern for volatilized alkali or sulfur bearing tars being deposited on the pipes.

Those skilled in the art will know, or be able to ascertain using no more than routine experimentation, many equivalents to the specific embodiments of the invention described herein. These and all other equivalents are intended to be encompassed by the following claims.

I claim:

1. A method of gasifying solid carbonaceous fuel, comprising the steps of:

(a) introducing solid carbonaceous fuel, an oxidant, and a combustible gas under pressure into a first end of an open-ended entrained bed pyrolyzer tube, said tube housed within a fixed bed pressure vessel with the tube extending through the fixed bed;

(b) igniting the combustible gas in order to devolatilize the fuel within the pyrolyzer tube and form ash, char, and volatiles;

(c) discharging the devolatilized fuel comprising char, ash, and volatiles from a second end of the pyrolyzer tube directly into the pressure vessel at a location above the fixed bed and passing the char, ash, and volatiles downwardly through a high temperature region of the fixed bed pressure vessel;

(d) introducing gasifying agents into the pressure vessel at a point adjacent to the second end of the pyrolyzer tube to crack any tar present;

(e) allowing said pressure vessel to heat to a temperature sufficient to oxidize the ash and char to carbonaceous gases, the ash and char descending by gravity;

(f) allowing unreacted char and ash to cool;

(g) removing ash, char, and volatiles from the pressure vessel.

2. A method of gasifying coal, comprising the steps of:

(a) introducing coal, a combustible gas, and oxidant into one end of an open-ended entrained-bed pyrolyzer tube housed within a fixed bed coal gasifier, with the tube extending through the fixed bed;

(b) igniting the combustible gas to about 1600° F. in order to devolatilize the coal;

(c) discharging devolatilized coal, gaseous volatiles and char from the other end of the pyrolyzer tube directly into the fixed-bed coal gasifier at a location above the fixed bed;

(d) introducing gasifying agents into the fixed bed-coal gasifier near the pyrolyzer other and in order to crack tar and asphalt fractions of coal;

(e) conveying char, ash, and unreacted coal by gravity feed into a heated zone of the fixed bed gasifier and passing the gaseous volatiles therewith through the heated zone of the gasifier;

(f) allowing the gasifier to heat to about 1900° F. in order to produce carbonaceous gases from the char, ash, and unreacted coal;

(g) removing gases from the gasifier;

(h) allowing ash to cool and to become deposited on a rotating grate;

(i) rotating the grate to remove ash, and char from the gasifier.

* * * * *